US010530033B2

(12) United States Patent
Moriguchi

(10) Patent No.: US 10,530,033 B2
(45) Date of Patent: Jan. 7, 2020

(54) DEMULTIPLEXER/MULTIPLEXER, ANTENNA DEVICE, AND FADING ELIMINATION METHOD

(71) Applicant: NEC Corporation, Minato-ku, Tokyo (JP)

(72) Inventor: Tatsuji Moriguchi, Tokyo (JP)

(73) Assignee: NEC CORPORATION, Tokyo (JP)

( * ) Notice: Subject to any disclaimer, the term of this patent is extended or adjusted under 35 U.S.C. 154(b) by 0 days.

(21) Appl. No.: 15/749,821

(22) PCT Filed: Aug. 2, 2016

(86) PCT No.: PCT/JP2016/003544
§ 371 (c)(1),
(2) Date: Feb. 2, 2018

(87) PCT Pub. No.: WO2017/026107
PCT Pub. Date: Feb. 16, 2017

(65) Prior Publication Data

US 2018/0233798 A1 Aug. 16, 2018

(30) Foreign Application Priority Data

Aug. 7, 2015 (JP) ..... 2015-156749

(51) Int. Cl.
*H01P 5/22* (2006.01)
*H01Q 3/38* (2006.01)
*H01Q 11/08* (2006.01)

(52) U.S. Cl.
CPC ..... *H01P 5/222* (2013.01); *H01P 5/227* (2013.01); *H01Q 3/38* (2013.01); *H01Q 11/083* (2013.01)

(58) Field of Classification Search
CPC .. H01P 5/22; H01P 5/222; H01Q 3/38; H01Q 11/08; H01Q 11/083; H01Q 21/006; H01Q 21/24
See application file for complete search history.

(56) References Cited

U.S. PATENT DOCUMENTS 3,906,509 A 9/1975 DuHamel
4,853,702 A 8/1989 Shiokawa et al.
(Continued)

FOREIGN PATENT DOCUMENTS

EP 2816664 A2 12/2014
FR 2934088 A1 1/2010
(Continued)

OTHER PUBLICATIONS

International Search Report for PCT Application No. PCT/JP2016/003544, dated Sep. 13, 2016.
(Continued)

*Primary Examiner* — Robert J Pascal
*Assistant Examiner* — Kimberly E Glenn

(57) ABSTRACT

A demultiplexer/multiplexer includes an input terminal, which receives input signals from respective phases of a quadrifilar helix antenna; phase shifter/separator/mixers, which alternately phase-shift right-handed and left-handed circularly polarized waves of the input signals, respectively, by 90°/−90° to produce phase-shifted waves to be combined in an inphase combination; phase shifter/mixers, which receive the left-handed or right-handed circularly polarized waves from the phase shifter/separator/mixers, and phase-shift one of the left-handed and right-handed circularly polarized waves by 180°/−180° to produce a phase-shifted wave to be combined with the other of the left-handed and right-handed circularly polarized waves in an antiphase combination; a variable phase shifter, which adjusts an output signal from the phase shifter/mixers by a phase-shift
(Continued)

amount that is received in advance; and an output terminal, which outputs an output signal from the variable phase shifter and the other output signal that is not input to the variable phase shifter.

6 Claims, 3 Drawing Sheets

(56) References Cited

U.S. PATENT DOCUMENTS

| | | | |
|---|---|---|---|
| 6,172,656 | B1 | 1/2001 | Ohwada et al. |
| 2008/0119149 | A1 | 5/2008 | Ll et al. |
| 2013/0229308 | A1 | 9/2013 | Pu et al. |

FOREIGN PATENT DOCUMENTS

| | | | |
|---|---|---|---|
| JP | S57-159138 | A | 10/1982 |
| JP | S58-24248 | A | 2/1983 |
| JP | 1014703 | B2 | 1/1989 |
| JP | H02-60307 | A | 2/1990 |
| JP | 6-222126 | A | 8/1994 |
| JP | 2508596 | B2 | 6/1996 |
| JP | 2007-173932 | A | 7/2007 |
| WO | 01/01518 | A1 | 1/2001 |
| WO | 2008/147465 | A2 | 12/2008 |

OTHER PUBLICATIONS

English translation of Written opinion for PCT Application No. PCT/JP2016/003544.

Communication dated Aug. 5, 2019, from the European Patent Office in counterpart European Application No. 16834809.2.

Steven (Shichang) Gao et al., "Broadband Circularly Polarized Antennas", John Wiley & Sons, Jan. 1, 2014, First Edition, pp. 73-129 (57 pages total).

Steven (Shichang) Gao et al., "Introduction to Circularly Polarized Antennas", John Wiley & Sons, Jan. 1, 2014, First Edition, pp. 1-28 (28 pages total).

Steven (Shichang) Gao et al., "Small Circularly Polarized Antenna", John Wiley & Sons, Jan. 1, 2014, First Edition, pp. 29-72 (44 pages total).

Extended European Search Report for EP Application No. EP16834809.2 dated Feb. 11, 2019.

DEMULTIPLEXER/MULTIPLEXER, ANTENNA DEVICE, AND FADING ELIMINATION METHOD

This application is a National Stage Entry of PCT/JP2016/003544 filed on Aug. 2, 2016, which claims priority from Japanese Patent Application 2015-156749 filed on Aug. 7, 2015, the contents of all of which are incorporated herein by reference, in their entirety.

TECHNICAL FIELD

This invention relates to a demultiplexer/multiplexer, which uses a quadrifilar helix antenna as an input/output antenna, an antenna device, and a fading elimination method.

BACKGROUND ART

One type of antenna is a quadrifilar helix antenna. The quadrifilar helix antenna is also sometimes called a quadrature helix antenna or four-wire helical antenna.

The quadrifilar helix antenna is described in Patent Documents 1 and 2, for example.

In Patent Document 1, a quadrifilar helix antenna device is disclosed. The quadrifilar helix antenna device of Patent Document 1 has the structure of supplying power to each helical antenna element in a non-contact manner. Moreover, in Patent Document 1, a 90° hybrid and a 180° hybrid are described. A hybrid is called a phase shifter, a mixer, a coupler, or a multiplexer, or is also sometimes called a hybrid phase shifter, a hybrid mixer, or a hybrid coupler.

Also in Patent Document 2, a quadrifilar helix antenna device is disclosed. The quadrifilar helix antenna device of Patent Document 2 includes the structure of switching between a first mode, which is a mode compatible with circularly polarized waves, and a second mode, which is a mode compatible with directly polarized waves, with a switch in each system. The quadrifilar helix antenna device connects a delay line to each helical antenna element to change the mode by switching from the first mode to the second mode with the switch in each system.

Further, related technologies are described also in Patent Documents 3 and 4.

In Patent Document 3, a fading elimination method for a single antenna for multipath generated on a sea surface. In Patent Document 3, there is disclosed a demultiplexer/multiplexer based on characteristics of the multipath generated on the sea surface. Moreover, in Patent Document 3, there are described a phase shifter (variable phase shifter) capable of adjusting an amount of phase shift, and an attenuator (variable attenuator) capable of adjusting an attenuance. Further, in Patent Document 3, there is described a combination circuit (corresponding to 180° combiner) of a phase shifter and a synthesizer (mixer), which performs phase shift by 180° and then combining. In this method, a hybrid coupler separates an antenna wave into a signal wave obtained by multiplexing a normally rotated direct wave (1) of a circularly polarized wave and a normally rotated reflected wave (2) of the circularly polarized wave, and a reversely rotated reflected wave (3) of the circularly polarized wave. Next, the attenuator and the phase shifter adjust the reversely rotated reflected wave (3) of the circularly polarized wave to an opposite phase and the same amplitude of the normally rotated reflected wave (2) of the circularly polarized wave. Finally, the synthesizer multiplexes the signal wave obtained by multiplexing the normally rotated direct wave (1) of the circularly polarized wave and the normally rotated reflected wave (2) of the circularly polarized wave, and a signal wave obtained by adjusting the reversely rotated reflected wave (3) of the polarized wave. As a result, the reflected wave generated on the sea surface can be ideally eliminated, and only the normally rotated direct wave (1) of the circularly polarized wave is obtained. This method is not a measure against fading for a quadrifilar helix antenna device. Moreover, the method is not a measure against fading generated on a ground surface or other surface.

Also in Patent Document 4, a demultiplexer/multiplexer is disclosed. In Patent Document 4, the demultiplexer/multiplexer includes one phase shifter (variable phase shifter), a four-beam changeover switch, and one combiner/splitter.

PRIOR ART DOCUMENT(S)

Patent Document(s)

Patent Document 1: WO 01/001518 A1
Patent Document 2: JP 2007-173932 A
Patent Document 3: JP H01-004703 A
Patent Document 4: JP 2508596 B2

SUMMARY OF THE INVENTION

Problem to be Solved by the Invention

In handling a quadrifilar helix antenna in an actual environment, an output signal from a quadrifilar helix antenna device is affected by a reflected wave (multipath) on the ground surface or other surface. Therefore, with existing quadrifilar helix antenna devices, it is difficult to make adjustments for achieving a stable receiving state in a simple manner in the actual environment. For example, a signal transmitted from a satellite is a weak electric wave on the ground, and it is unclear what and how the quadrifilar helix antenna device can adjust as a measure against fading of the wave reflected on the ground surface.

In Patent Documents 1, 2, and 4 described above, measures against fading due to multipath are not disclosed. Moreover, in Patent Document 3, measures against fading for the quadrifilar helix antenna device are not disclosed. Moreover, measures against fading generated on a surface other than the sea surface are not disclosed.

In other words, none of Patent Documents 1 to 4 described above provides a measure against fading for the quadrifilar helix antenna device.

In the actual environment, when a weak received signal from an artificial satellite is strongly affected by a multipath signal generated on the ground surface, a level of a main signal may become significantly weaker in the quadrifilar helix antenna device in some cases.

In view of the above-mentioned circumstances, the inventor of this invention has considered a demultiplexer/multiplexer, which is useful in reducing signal degradation due to multipath in an antenna device portion using a quadrifilar helix antenna.

This invention has been made in view of the above-mentioned circumstances, and therefore provides a demultiplexer/multiplexer to be connected to a quadrifilar helix antenna for reducing a multipath effect, and an antenna device of a quadrifilar helix antenna.

This invention also provides a fading elimination method for a quadrifilar helix antenna.

Means to Solve the Problem

A demultiplexer/multiplexer according to one embodiment of this invention includes an input terminal, which is connected to each phase of a quadrifilar helix antenna having phases 1 to 4 (phase 1, phase 2, phase 3, and phase 4) to receive input signals of phases 1 to 4; a first phase shifter/separator/mixer, which receives the input signal of phase 1 and the input signal of phase 2 from the input terminal, and is configured to alternately phase shift the input signal of phase 1 and the input signal of phase 2, respectively, by 90° or −90° to produce phase-shifted signals and then combine the phase-shifted signals in an inphase combination to output a first left-handed circularly polarized wave and a first right-handed circularly polarized wave; a second phase shifter/separator/mixer, which receives the input signal of phase 3 and the input signal of phase 4 from the input terminal, and is configured to alternately phase shift the input signal of phase 3 and the input signal of phase 4, respectively, by 90° or −90° to produce phase-shifted signals and then combine the phase-shifted signals in an inphase combination to output a third left-handed circularly polarized wave and a fourth right-handed circularly polarized wave; a first phase shifter/mixer, which receives the first left-handed circularly polarized wave and the second left-handed circularly polarized wave, and is configured to phase shift one of the first left-handed circularly polarized wave and the second left-handed circularly polarized wave by 180° or −180° to produce a phase-shifted wave, and then combine the phase-shifted wave and the other of the first left-handed circularly polarized wave and the second left-handed circularly polarized wave in an antiphase combination to output a combined left-handed circularly polarized wave; a second phase shifter/mixer, which receives the first right-handed circularly polarized wave and the second right-handed circularly polarized wave, and is configured to phase shift one of the first right-handed circularly polarized wave and the second right-handed circularly polarized wave by 180° or −180° to produce a phase-shifted wave, and then combine the phase-shifted wave and the other of the first right-handed circularly polarized wave and the second right-handed circularly polarized wave in an inphase combination to output a combined right-handed circularly polarized wave; a variable phase shifter, which receives one of the combined left-handed circularly polarized wave and the combined right-handed circularly polarized wave, and is configured to adjust the received one of the combined left-handed circularly polarized wave and the combined right-handed circularly polarized wave by an amount of phase shift that is received in advance from a control terminal, to output the adjusted circularly polarized wave; and an output terminal, which outputs the adjusted circularly polarized wave, and the other of the combined left-handed circularly polarized wave and the combined right-handed circularly polarized wave.

An antenna device according to one embodiment of this invention includes the above-mentioned demultiplexer/multiplexer and the quadrifilar helix antenna, which is connected to the input terminal of the demultiplexer/multiplexer.

A fading elimination method, which is performed by a demultiplexer/multiplexer, according to one embodiment of this invention includes receiving input signals of phases 1 to 4 from an input terminal, which is connected to each phase of a quadrifilar helix antenna having phases 1 to 4 (phase 1, phase 2, phase 3, and phase 4); receiving the input signal of phase 1 and the input signal of phase 2 from the input terminal, alternately phase shifting the input signal of phase 1 and the input signal of phase 2, respectively, by 90° or −90° to produce phase-shifted signals, and then combining the phase-shifted signals in an inphase combination to output a first left-handed circularly polarized wave and a first right-handed circularly polarized wave; receiving the input signal of phase 3 and the input signal of phase 4 from the input terminal, alternately phase shifting the input signal of phase 3 and the input signal of phase 4, respectively, by 90° or −90° to produce phase-shifted signals, and then combining the phase-shifted signals in an inphase combination to output a third left-handed circularly polarized wave and a fourth right-handed circularly polarized wave; receiving the first left-handed circularly polarized wave and the second left-handed circularly polarized wave, phase shifting one of the first left-handed circularly polarized wave and the second left-handed circularly polarized wave by 180° or −180° to produce a phase-shifted wave, and then combining the phase-shifted wave and the other of the first left-handed circularly polarized wave and the second left-handed circularly polarized wave in an antiphase combination to output a combined left-handed circularly polarized wave; receiving the first right-handed circularly polarized wave and the second right-handed circularly polarized wave, phase shifting one of the first right-handed circularly polarized wave and the second right-handed circularly polarized wave by 180° or −180° to produce a phase-shifted wave, and then combining the phase-shifted wave and the other of the first right-handed circularly polarized wave and the second right-handed circularly polarized wave in an inphase combination to output a combined right-handed circularly polarized wave; receiving one of the combined left-handed circularly polarized wave and the combined right-handed circularly polarized wave, and adjusting the received one of the combined left-handed circularly polarized wave and the combined right-handed circularly polarized wave by an amount of phase shift that is received in advance from a control terminal, to output the adjusted circularly polarized wave; and outputting the adjusted circularly polarized wave, and the other of the combined left-handed circularly polarized wave and the combined right-handed circularly polarized wave from an output terminal.

Effect of the Invention

According to this invention, the demultiplexer/multiplexer to be connected to the quadrifilar helix antenna for reducing a multipath effect, and the antenna device of the quadrifilar helix antenna can be provided.

Similarly, according to this invention, the fading elimination method for a quadrifilar helix antenna can be provided.

MODE FOR EMBODYING THE INVENTION

An embodiment of this invention is described with reference to FIG. 1 to FIG. 3.

For convenience of description, this embodiment is based on the assumption that a satellite signal is received by a quadrifilar helix antenna device installed on the ground.

In general, in multipath reflected on a ground surface, phase shift of a main rotated circularly polarized wave component may be displaced to generate a reversely rotated circularly polarized wave component with respect to a direct wave (main rotated circularly polarized wave).

Moreover, detailed description of elements (e.g., signal combining unit (multiplexer), amplifier, demodulator, digital signal processor, and information processing unit) in the subsequent stage of the quadrifilar helix antenna device is omitted. The elements in the subsequent stage of the quadrifilar helix antenna device may perform desired analog signal processing, digital signal processing, information processing, and other processing as appropriate. Moreover, the elements in the subsequent stage may take further measures against fading.

Figure 1:
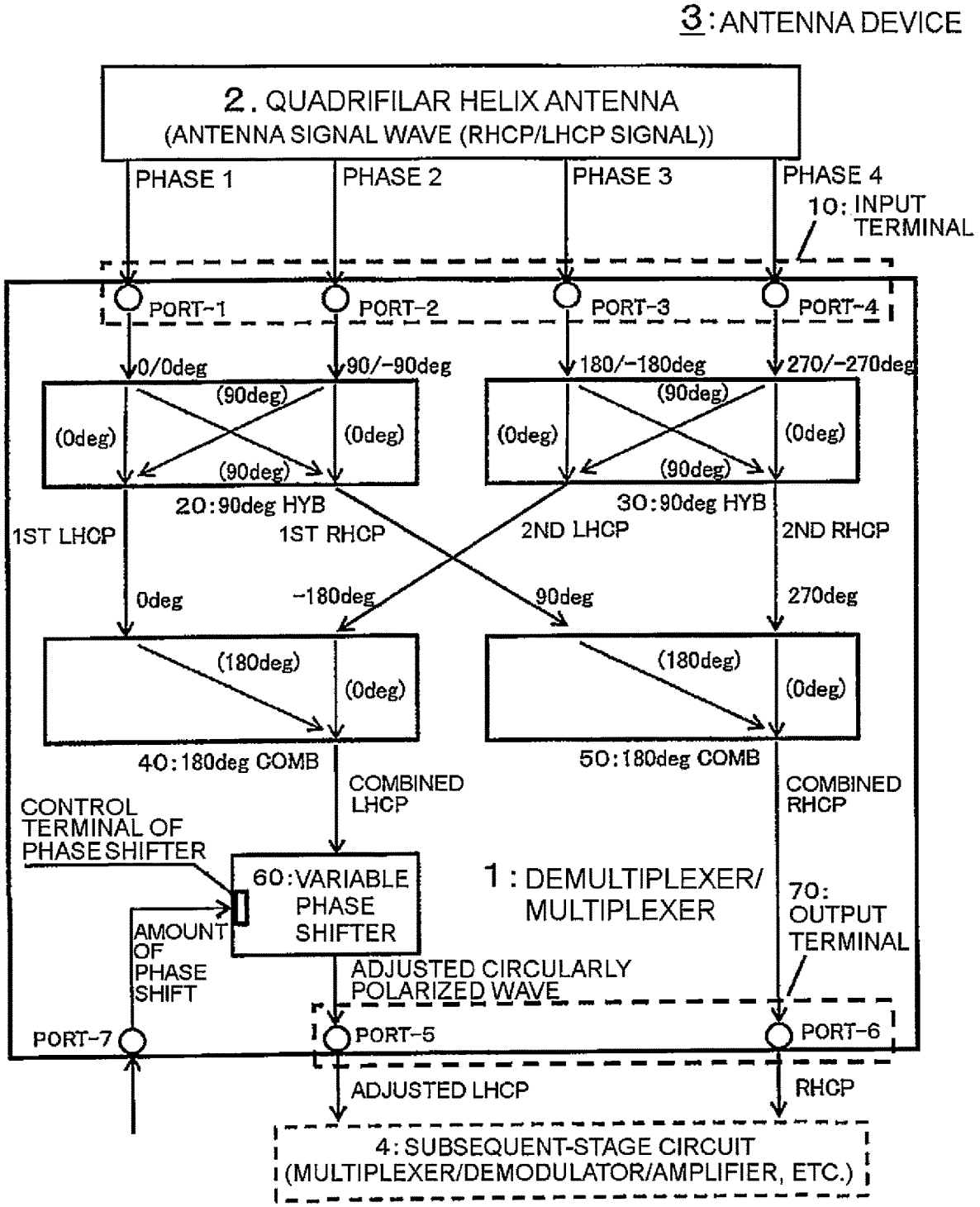
FIG. 1 is a functional block diagram for illustrating a demultiplexer/multiplexer according to a first embodiment of this invention.

FIG. 1 is a functional block diagram for illustrating a demultiplexer/multiplexer 1 according to a first embodiment of this invention. FIG. 2 is a schematic diagram for illustrating an example of a quadrifilar helix antenna device 3 including the demultiplexer/multiplexer 1. As illustrated in FIG. 1 and FIG. 2, the demultiplexer/multiplexer 1 and a quadrifilar helix antenna 2 form the quadrifilar helix antenna device 3. Moreover, a shape of the quadrifilar helix antenna 2 is merely an example, and the quadrifilar helix antenna may have a shape other than the illustrated shape in which four antenna elements are wound into a rod shape. In FIG. 1 and FIG. 2, the reference symbol "RHCP" represents a right-handed circularly polarized (RHCP) signal, and the reference symbol "LHCP" represents a left-handed circularly polarized (LHCP) signal.

The demultiplexer/multiplexer 1 according to the first embodiment is formed using an input terminal 10, a first phase shifter/separator/mixer 20, a second phase shifter/separator/mixer 30, a first phase shifter/mixer 40, a second phase shifter/mixer 50, a variable phase shifter 60, and an output terminal 70.

The quadrifilar helix antenna 2 includes systems of phases 1 to 4 each having a phase difference of 90°, and each system is isolated. Antenna signal waves (received waves of phases 1 to 4) of the respective systems are connected to the input terminal 10 of the demultiplexer/multiplexer 1.

The quadrifilar helix antenna device 3 is a combination of the demultiplexer/multiplexer 1 and the quadrifilar helix antenna 2.

The input terminal 10 is connected to elements of the respective systems to receive input signals (received waves) of phases 1 to 4, respectively. A signal wave entering the input terminal 10 contains the main rotated circularly polarized wave and reversely rotated circularly polarized wave components. For example, when the main rotated circularly polarized wave is a right-handed wave, a left-handed wave, which is the reversely rotated circularly polarized wave component, is also mixed in the signal wave entering the input terminal in reality. In the first embodiment, a configuration in which the main rotated circularly polarized wave is a right-handed circularly polarized wave is described. A configuration in which the main rotated circularly polarized wave is a left-handed circularly polarized wave is obtained simply by switching the left and right as appropriate.

The first phase shifter/separator/mixer 20 in the first embodiment is formed of a 90° hybrid (HYB in FIG. 1). The first phase shifter/separator/mixer 20 receives input signals of phase 1 and phase 2 from the input terminal 10, and is configured to alternately phase shift a right-handed circularly polarized wave (main rotated circularly polarized wave) and a left-handed circularly polarized wave (reversely rotated circularly polarized wave) of each input signal, respectively, by 90° to produce phase-shifted waves, and combine the phase-shifted waves in an inphase combination. The first phase shifter/separator/mixer 20 outputs a combined signal wave as a first right-handed circularly polarized wave. The first phase shifter/separator/mixer 20 may combine the waves after phase shifting the waves by an amount of phase of −90° instead of 90°.

The second phase shifter/separator/mixer 30 in the first embodiment is formed of a 90° hybrid (HYB in FIG. 1). The second phase shifter/separator/mixer 30 receives input signals of phase 3 and phase 4 from the input terminal 10, and is configured to alternately phase shift a right-handed circularly polarized wave (main rotated circularly polarized wave) and a left-handed circularly polarized wave (reversely rotated circularly polarized wave) of each input signal, respectively, by 90° to produce phase-shifted waves, and then combine the phase shifted waves in an inphase combination. The second phase shifter/separator/mixer 30 outputs a combined signal wave as a second right-handed circularly polarized wave. The second phase shifter/separator/mixer 30 may combine the waves after phase shifting the waves by an amount of phase of −90° instead of 90°.

The first phase shifter/mixer 40 in the first embodiment is formed of a 180° combiner (COMB in FIG. 1). The first phase shifter/mixer 40 receives the left-handed circularly polarized wave from each of the first phase shifter/separator/mixer 20 and the second phase shifter/separator/mixer 30, and is configured to phase shift and combine the waves. In the phase shifting and combining, one of the input signals received from the first phase shifter/separator/mixer 20 and the second phase shifter/separator/mixer 30 is phase shifted by 180°, and then combined with the other in an antiphase combination. The first phase shifter/mixer 40 outputs a combined signal wave as a combined left-handed circularly polarized wave. The first phase shifter/mixer 40 may combine the waves after phase shifting the waves by an amount of phase of −180° instead of 180°. In FIG. 1, there is illustrated a configuration of the first phase shifter/mixer 40 in which the input signal received from the second phase shifter/separator/mixer 30 is phase shifted.

The second phase shifter/mixer 50 in the first embodiment is formed of a 180° combiner (COMB in FIG. 1). The second phase shifter/mixer 50 receives the right-handed circularly polarized wave from each of the first phase shifter/separator/mixer 20 and the second phase shifter/separator/mixer 30, and is configured to phase shift and combine the waves. In the phase shifting and combining, one of the input signals received from the first phase shifter/separator/mixer 20 and the second phase shifter/separator/mixer 30 is phase shifted by 180°, and then combined with the other in an inphase combination. The second phase shifter/mixer 50 outputs a combined signal wave as a combined right-handed circularly polarized wave. The second phase shifter/mixer 50 may combine the waves after phase shifting the waves by an amount of phase of −180° instead of 180°. In FIG. 1, there is illustrated a configuration of the second phase shifter/mixer 50 in which the input signal received from the first phase shifter/separator/mixer 20 is phase shifted.

The variable phase shifter 60 receives the output signal from the first phase shifter/mixer 40, and is configured to adjust the received output signal with an amount of phase shift that is received in advance from a control terminal. The amount of phase shift to be input to the control terminal may be adjusted so that fading elimination is maximized. This adjustment may be performed artificially, or an automatic adjustment circuit configured to adjust the amount of phase shift may be provided in the demultiplexer/multiplexer 1 to automatically adjust the amount of phase shift. Moreover, a computer in a subsequent-stage circuit may automatically adjust the amount of phase shift. The variable phase shifter 60 outputs the adjusted signal wave as an adjusted circularly polarized wave. There may be adopted a configuration in which, instead of adjusting the output signal from the first phase shifter/mixer 40, the output signal from the second phase shifter/mixer 50 is adjusted.

The output terminal 70 outputs the output signal from the variable phase shifter 60, and the output signal from the other of the first phase shifter/mixer 40 or the second phase shifter/mixer 50, which is not input to the variable phase shifter 60.

The output signal is used in an electric network (e.g., multiplexer, demodulator, amplifier, signal processing unit, and information processing unit, which are arranged as appropriate) arranged in the subsequent stage.

Overall operation of the antenna device 3 of the first embodiment is described with reference to FIG. 1, FIG. 2, and FIG. 3.

Figure 3:
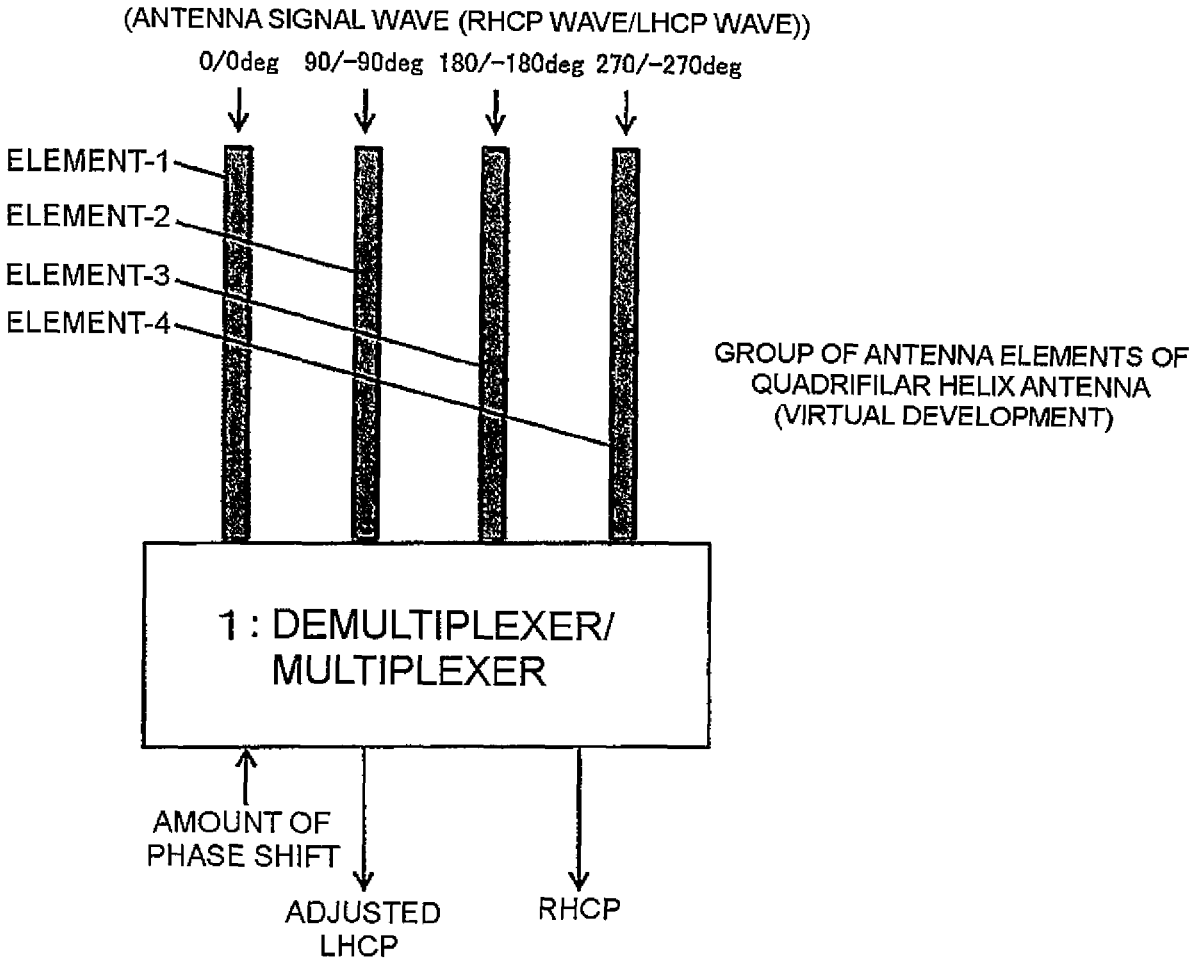
FIG. 3 is an explanatory diagram for illustrating phase differences of a signal wave reaching a quadrifilar helix antenna 2.

FIG. 3 is an explanatory diagram for illustrating phase differences of the signal waves reaching the quadrifilar helix antenna 2. In FIG. 3, each antenna element of the quadrifilar helix antenna 2 is illustrated as being extended in a plate shape.

As illustrated in FIG. 3, to each antenna element, a signal in which each of the right-handed circularly polarized wave and the left-handed circularly polarized wave has a phase difference of 90° is input. When the antenna element of phase 1 is 0°, the right-handed circularly polarized (RHCP) signals have phase differences of 0 deg, 90 deg, 180 deg, and 270 deg, respectively, and the left-handed circularly polarized (LHCP) signals have phase differences of 0 deg, −90 deg, −180 deg, and −270 deg, respectively.

Figure 2:
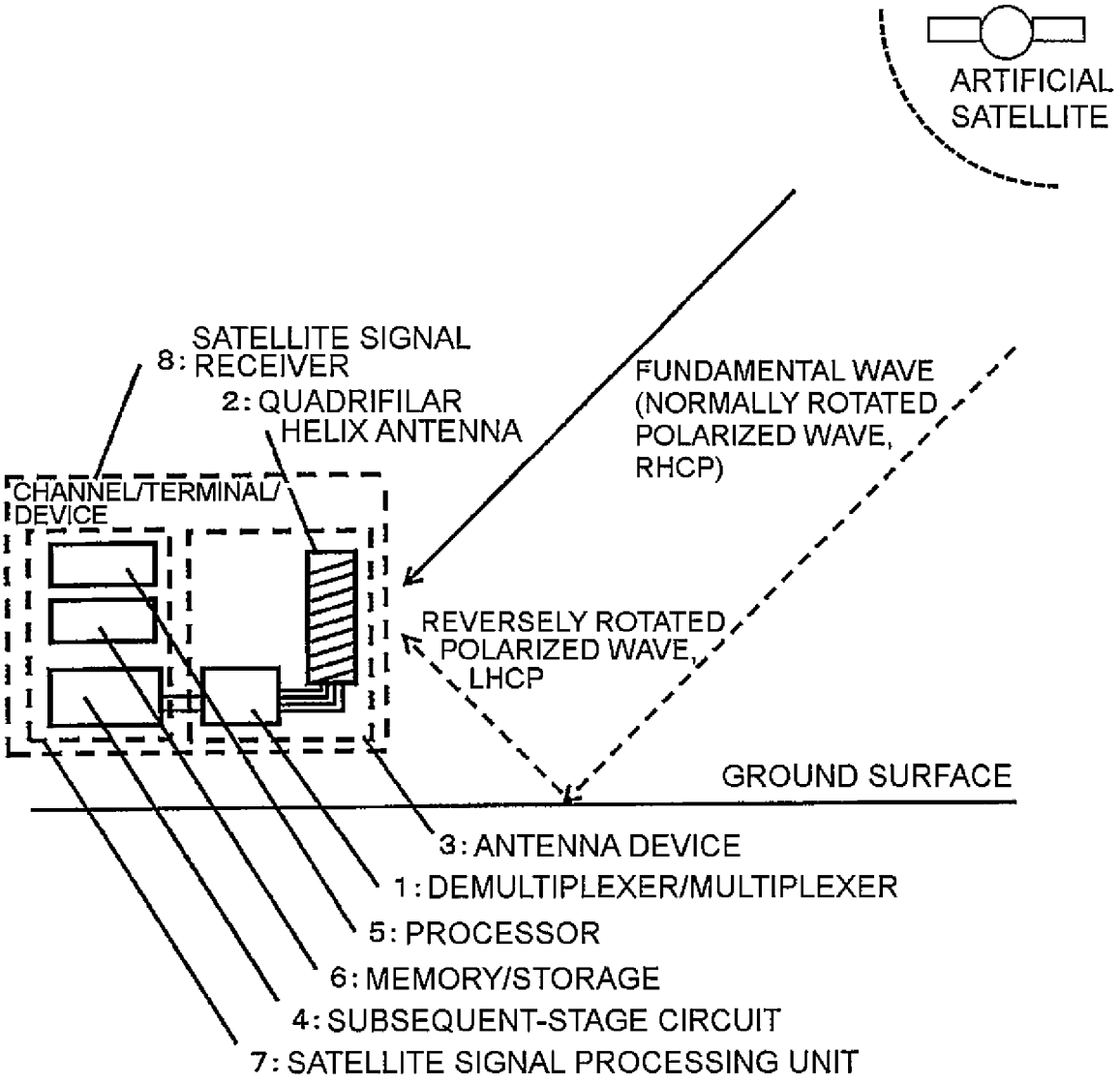
FIG. 2 is a schematic diagram for illustrating an arrangement example of a quadrifilar helix antenna device 3 of the first embodiment.

As illustrated in FIG. 2, a circularly polarized signal from an artificial satellite is received by a satellite signal receiver 8 (antenna device 3, quadrifilar helix antenna 2, and four helical antenna elements). At this time, of the circularly polarized signals from the satellite, a signal wave directly enters the antenna, and the other signal wave enters the quadrifilar helix antenna 2 after being reflected on a ground surface. The two signal waves interfere with each other to weaken or strengthen a radio wave. When a main signal from the satellite is right-handed circularly polarized (RHCP), the wave reflected on the ground may be displaced to form a left-handed circularly polarized (LHCP) component.

The antenna device 3 first separates, phase shifts, and combines each signal wave received by the quadrifilar helix antenna 2 for every two phases in the first phase shifter/separator/mixer 20 and the second phase shifter/separator/mixer 30. Next, the antenna device 3 phase shifts and combines the signal waves in the first phase shifter/mixer 40 and the second phase shifter/mixer 50 to obtain a combined right-handed circularly polarized wave component and a combined left-handed circularly polarized wave component, respectively.

When the antenna signal waves of four phases are allowed to pass through such electric network, a mixed wave of RHCP waves is output from one of the first phase shifter/mixer 40 and the second phase shifter/mixer 50, and a mixed wave of LHCP waves are output from the other.

One of the two mixed waves is adjusted in the variable phase shifter 60, and is output together with the unadjusted mixed wave to a subsequent-stage circuit 4.

The two mixed waves can be used to obtain a substantially useful signal having a high signal level from the quadrifilar helix antenna 2 as the antenna device 3. In other words, the antenna device 3 of the quadrifilar helix antenna 2 that is less susceptible to influence of a multipath signal can be obtained.

Meanwhile, a satellite signal processing unit 7 is configured to multiplex the two mixed waves obtained from the antenna device 3 after amplifying or attenuating the two combined waves in the subsequent-stage circuit 5 as necessary. As a result, obtainment of a highly accurate satellite signal and satisfactory information processing can be achieved.

As described above, the demultiplexer/multiplexer and the antenna device to which this invention is applied can provide a mechanism of reducing a multipath effect.

That is, according to this invention, the demultiplexer/multiplexer to be connected to the quadrifilar helix antenna for reducing a multipath effect, and the antenna device of the quadrifilar helix antenna can be provided.

Similarly, according to this invention, the fading elimination method for the quadrifilar helix antenna can be provided.

Further, the specific configuration according to this invention is not limited to the embodiment described above, and this invention encompasses changes made without departing from the gist of this invention.

Further, part or whole of the above-mentioned embodiment can also be described as follows. The following supplementary notes are not intended to limit this invention.

[Supplementary Note 1]

A demultiplexer/multiplexer, including:

an input terminal, which is connected to each phase of a quadrifilar helix antenna having phases 1 to 4 to receive input signals of phases 1 to 4;

a first phase shifter/separator/mixer, which receives the input signal of phase 1 and the input signal of phase 2 from the input terminal, and is configured to alternately phase shift the input signal of phase 1 and the input signal of phase 2, respectively, by 90° or −90° to produce phase-shifted signals and then combine the phase-shifted signals in an inphase combination to output a first left-handed circularly polarized wave and a first right-handed circularly polarized wave;

a second phase shifter/separator/mixer, which receives the input signal of phase 3 and the input signal of phase 4 from the input terminal, and is configured to alternately phase shift the input signal of phase 3 and the input signal of phase 4, respectively, by 90° or −90° to produce phase-shifted signals and then combine the phase-shifted signals in an inphase combination to output a third left-handed circularly polarized wave and a fourth right-handed circularly polarized wave;

a first phase shifter/mixer, which receives the first left-handed circularly polarized wave and the second left-handed circularly polarized wave, and is configured to phase shift one of the first left-handed circularly polarized wave and the second left-handed circularly polarized wave by 180° or −180° to produce a phase-shifted wave, and then combine the phase-shifted wave and the other of the first left-handed circularly polarized wave and the second left-handed circularly polarized wave in an antiphase combination to output a combined left-handed circularly polarized wave;

a second phase shifter/mixer, which receives the first right-handed circularly polarized wave and the second right-handed circularly polarized wave, and is configured to phase shift one of the first right-handed circularly polarized wave and the second right-handed circularly polarized wave by 180° or −180° to produce a phase-shifted wave, and then combine the phase-shifted wave and the other of the first right-handed circularly polarized wave and the second right-handed circularly polarized wave in an inphase combination to output a combined right-handed circularly polarized wave;

a variable phase shifter, which receives one of the combined left-handed circularly polarized wave and the combined right-handed circularly polarized wave, and is configured to adjust the received one of the combined left-handed circularly polarized wave and the combined right-handed circularly polarized wave by an amount of phase shift that is received in advance from a control terminal, to output the adjusted circularly polarized wave; and an output terminal, which outputs the adjusted circularly polarized wave, and the other of the combined left-handed circularly polarized wave and the combined right-handed circularly polarized wave.

[Supplementary Note 2]

The demultiplexer/multiplexer according to the above-mentioned Supplementary Note, further comprising a multiplexer, which is configured to combine the adjusted circularly polarized wave and the other of the combined left-handed circularly polarized wave and the combined right-handed circularly polarized wave.

[Supplementary Note 3]

The demultiplexer/multiplexer according to the above-mentioned Supplementary Note, wherein the first phase shifter/separator/mixer and the second phase shifter/separator/mixer each include a hybrid.

[Supplementary Note 4]

The demultiplexer/multiplexer according to the above-mentioned Supplementary Note, wherein the first phase shifter/mixer and the second phase shifter/mixer each include a combiner.

[Supplementary Note 5]

The demultiplexer/multiplexer according to the above-mentioned Supplementary Note, further including an automatic adjustment circuit, which is configured to adjust the amount of phase shift to be input to the variable phase shifter so that an output power of the variable phase shifter is maximized.

[Supplementary Note 6]

An antenna device, including the demultiplexer/multiplexer according to the above-mentioned Supplementary Note, and the quadrifilar helix antenna, which is connected to the input terminal of the demultiplexer/multiplexer.

[Supplementary Note 7]

A satellite signal receiver, including the antenna device of the above-mentioned Supplementary Note; and a satellite signal processing unit, which is configured to use a satellite signal received from the antenna device.

[Supplementary Note 8]

The satellite signal receiver according to the above-mentioned Supplementary Note, further including a satellite signal processing unit, which is configured to adjust the amount of phase shift to be input to the variable phase shifter so that an output power of the variable phase shifter is maximized.

[Supplementary Note 9]

A fading elimination method, which is performed by a demultiplexer/multiplexer, the fading elimination method comprising:

receiving input signals of phases 1 to 4 from an input terminal, which is connected to each phase of a quadrifilar helix antenna having phases 1 to 4;

receiving the input signal of phase 1 and the input signal of phase 2 from the input terminal, alternately phase shifting the input signal of phase 1 and the input signal of phase 2, respectively, by 90° or −90° to produce phase-shifted signals, and then combining the phase-shifted signals in an inphase combination to output a first left-handed circularly polarized wave and a first right-handed circularly polarized wave;

receiving the input signal of phase 3 and the input signal of phase 4 from the input terminal; alternately phase shifting the input signal of phase 3 and the input signal of phase 4, respectively, by 90° or −90° to produce phase-shifted signals, and then combining the phase-shifted signals in an inphase combination to output a third left-handed circularly polarized wave and a fourth right-handed circularly polarized wave;

receiving the first left-handed circularly polarized wave and the second left-handed circularly polarized wave, phase shifting one of the first left-handed circularly polarized wave and the second left-handed circularly polarized wave by 180° or −180° to produce a phase-shifted wave, and then combining the phase-shifted wave and the other of the first left-handed circularly polarized wave and the second left-handed circularly polarized wave in an antiphase combination to output a combined left-handed circularly polarized wave;

receiving the first right-handed circularly polarized wave and the second right-handed circularly polarized wave, phase shifting one of the first right-handed circularly polarized wave and the second right-handed circularly polarized wave by 180° or −180° to produce a phase-shifted wave, and then combining the phase-shifted wave and the other of the first right-handed circularly polarized wave and the second right-handed circularly polarized wave in an inphase combination to output a combined right-handed circularly polarized wave;

receiving one of the combined left-handed circularly polarized wave and the combined right-handed circularly polarized wave, and adjusting the received one of the combined left-handed circularly polarized wave and the combined right-handed circularly polarized wave by an amount of phase shift that is received in advance from a control terminal, to output the adjusted circularly polarized wave; and outputting the adjusted circularly polarized wave, and the other of the combined left-handed circularly polarized wave and the combined right-handed circularly polarized wave from an output terminal.

[Supplementary Note 10]

The fading elimination method according to the above-mentioned Supplementary Note, further including combining, by a multiplexer, the adjusted circularly polarized wave and the other of the combined left-handed circularly polarized wave and the combined right-handed circularly polarized wave.

This invention can be used for a satellite signal receiver (antenna device portion), which is useful in telemetry with and command transmission to a communication satellite or an observation satellite, for example. Moreover, this invention can be used, in addition to satellite communication, to a device configured to perform communication using the quadrifilar helix antenna.

This application claims priority from Japanese Patent Application No. 2015-156749, filed on Aug. 7, 2015, the entire disclosure of which is incorporated herein by reference.

EXPLANATION OF REFERENCE NUMERALS

1 demultiplexer/multiplexer
2 quadrifilar helix antenna
3 antenna device
4 subsequent-stage circuit
5 processor
6 memory/storage
7 satellite signal processing unit
8 satellite signal receiver
10 input terminal
20 first phase shifter/separator/mixer
30 second phase shifter/separator/mixer
40 first phase shifter/mixer
50 second phase shifter/mixer
60 variable phase shifter
70 output terminal

The invention claimed is:

1. A demultiplexer/multiplexer, comprising:

an input terminal, which is connected to each phase of a quadrifilar helix antenna having phases of phase 1, phase 2, phase 3, and phase 4 to receive input signals as an input signal of phase 1, an input signal of phase 2, an input signal of phase 3, and an input signal of phase 4;

a first phase shifter/separator/mixer, which receives the input signal of phase 1 and the input signal of phase 2 from the input terminal, and is configured to alternately phase shift the input signal of phase 1 and the input signal of phase 2, respectively, by 90° or −90° to produce first phase-shifted signals and then combine the first phase-shifted signals in an inphase combination to output a first left-handed circularly polarized wave and a first right-handed circularly polarized wave;

a second phase shifter/separator/mixer, which receives the input signal of phase 3 and the input signal of phase 4 from the input terminal, and is configured to alternately phase shift the input signal of phase 3 and the input signal of phase 4, respectively, by 90° or −90° to produce second phase-shifted signals and then combine the second phase-shifted signals in an inphase combination to output a second left-handed circularly polarized wave and a second right-handed circularly polarized wave;

a first phase shifter/mixer, which receives the first left-handed circularly polarized wave and the second left-handed circularly polarized wave, and is configured to phase shift one of the first left-handed circularly polarized wave and the second left-handed circularly polarized wave by 180° or −180° to produce a first phase-shifted wave, and then combine the first phase-shifted wave and the other of the first left-handed circularly polarized wave and the second left-handed circularly polarized wave in an antiphase combination to output a combined left-handed circularly polarized wave;

a second phase shifter/mixer, which receives the first right-handed circularly polarized wave and the second right-handed circularly polarized wave, and is configured to phase shift one of the first right-handed circularly polarized wave and the second right-handed circularly polarized wave by 180° or −180° to produce a second phase-shifted wave, and then combine the second phase-shifted wave and the other of the first right-handed circularly polarized wave and the second right-handed circularly polarized wave in an inphase combination to output a combined right-handed circularly polarized wave;

a variable phase shifter, which receives one of the combined left-handed circularly polarized wave and the combined right-handed circularly polarized wave, and is configured to adjust the received one of the combined left-handed circularly polarized wave and the combined right-handed circularly polarized wave by an amount of phase shift that is received in advance from a control terminal, to output an adjusted circularly polarized wave; and an output terminal, which outputs the adjusted circularly polarized wave, and the other of the combined left-handed circularly polarized wave and the combined right-handed circularly polarized wave.

2. The demultiplexer/multiplexer according to claim 1, further comprising a multiplexer, which is configured to combine the adjusted circularly polarized wave and the other of the combined left-handed circularly polarized wave and the combined right-handed circularly polarized wave.

3. The demultiplexer/multiplexer according to claim 1, wherein the first phase shifter/separator/mixer and the second phase shifter/separator/mixer each include a hybrid.

4. The demultiplexer/multiplexer according to claim 1, wherein the first phase shifter/mixer and the second phase shifter/mixer each include a combiner.

5. An antenna device, comprising:

the demultiplexer/multiplexer of claim 1; and the quadrifilar helix antenna, which is connected to the input terminal of the demultiplexer/multiplexer.

6. A fading elimination method, which is performed by a demultiplexer/multiplexer, the fading elimination method comprising:

receiving input signals as an input signal of phase 1, an input signal of phase 2, an input signal of phase 3, and an input signal of phase 4 from an input terminal, which is connected to each phase of a quadrifilar helix antenna having phases of phase 1, phase 2, phase 3, and phase 4;

receiving the input signal of phase 1 and the input signal of phase 2 from the input terminal, alternately phase shifting the input signal of phase 1 and the input signal of phase 2, respectively, by 90° or −90° to produce first phase-shifted signals, and then combining the first phase-shifted signals in an inphase combination to output a first left-handed circularly polarized wave and a first right-handed circularly polarized wave;

receiving the input signal of phase 3 and the input signal of phase 4 from the input terminal, alternately phase shifting the input signal of phase 3 and the input signal of phase 4, respectively, by 90° or −90° to produce second phase-shifted signals, and then combining the second phase-shifted signals in an inphase combination to output a second left-handed circularly polarized wave and a second right-handed circularly polarized wave;

receiving the first left-handed circularly polarized wave and the second left-handed circularly polarized wave, phase shifting one of the first left-handed circularly polarized wave and the second left-handed circularly polarized wave by 180° or −180° to produce a first phase-shifted wave, and then combining the first phase-shifted wave and the other of the first left-handed circularly polarized wave and the second left-handed circularly polarized wave in an antiphase combination to output a combined left-handed circularly polarized wave;

receiving the first right-handed circularly polarized wave and the second right-handed circularly polarized wave, phase shifting one of the first right-handed circularly polarized wave and the second right-handed circularly polarized wave by 180° or −180° to produce a second phase-shifted wave, and then combining the second phase-shifted wave and the other of the first right-handed circularly polarized wave and the second right-handed circularly polarized wave in an inphase combination to output a combined right-handed circularly polarized wave;

receiving one of the combined left-handed circularly polarized wave and the combined right-handed circularly polarized wave, and adjusting the received one of the combined left-handed circularly polarized wave and the combined right-handed circularly polarized wave by an amount of phase shift that is received in advance from a control terminal, to output an adjusted circularly polarized wave; and outputting the adjusted circularly polarized wave, and the other of the combined left-handed circularly polarized wave and the combined right-handed circularly polarized wave from an output terminal.

* * * * *